United States Patent [19]

Beelmann et al.

[11] 4,161,293

[45] Jul. 17, 1979

[54] BLOWER BEATER MILL

[75] Inventors: Richard Beelmann, Mülheim; Johannes Kerstges, Oberhausen; Paul Mertens, Mülheim, all of Fed. Rep. of Germany

[73] Assignee: Deutsche Babcock Aktiengesellschaft, Oberhausen, Fed. Rep. of Germany

[21] Appl. No.: 860,768

[22] Filed: Dec. 15, 1977

[30] Foreign Application Priority Data

Dec. 23, 1976 [DE] Fed. Rep. of Germany ..... 2658469

[51] Int. Cl.[2] ..... B02C 13/10

[52] U.S. Cl. ..... 241/56; 241/67; 241/191

[58] Field of Search ..... 241/56, 66, 67, 188 R, 241/189 R, 189 A, 191, 194

[56] References Cited

U.S. PATENT DOCUMENTS

| | | | |
|---|---|---|---|
| 551,097 | 12/1895 | Russell | 241/188 R X |
| 1,038,886 | 9/1912 | Hirt | 241/188 R X |
| 3,157,366 | 11/1964 | Rogers | 241/56 UX |
| 3,880,366 | 4/1975 | Loevenich | 241/194 |
| 3,993,254 | 11/1976 | Bicik et al. | 241/67 |
| 4,008,858 | 2/1977 | Yamada et al. | 241/67 |

FOREIGN PATENT DOCUMENTS

| | | | |
|---|---|---|---|
| 2605751 | 9/1976 | Fed. Rep. of Germany | 241/194 |

*Primary Examiner*—Howard N. Goldberg
*Attorney, Agent, or Firm*—Max Fogiel

[57] ABSTRACT

A blower beater mill for grinding and drying, in which a rotor has a beater portion located on a mill shaft and a fan impeller. Beater arms of the beater portion are fastened between hub rings of the mill shaft. The shaft is, furthermore, water-cooled along its longitudinal axis, and shaft cams of the hub rings are enclosed at a distance by an outside jacket having cutouts for passage of the beater arms. The space between the outer jacket and the shaft cams of the hub rings may be filled with insulating material. The shaft cams of the hub rings may have also a heat-reflecting coating. The width of the cutouts may be greater than the width of the beater arms by the amount of maximum axial expansion of the outer jacket relative to the mill shaft. The outer jacket, moreover, is restricted to the portion of the beater part located underneath the mill intake, and reaches to the first row of the beater arms. The beater arms have bases filling the space between two hub rings, and the distance between two adjacent beater arms bases of a beater arm row in the peripheral direction, is at most 0.3 times the distance between two hub rings.

7 Claims, 3 Drawing Figures

BLOWER BEATER MILL

BACKGROUND OF THE INVENTION

The present invention relates to a blower beater mill for grinding and drying. A rotor comprises a beater portion and a fan impeller both located on the mill shaft. The beater arms of the beater portion are fastened between hub rings of the mill shaft. The mill shaft is water-cooled along its longitudinal axis.

Such mills, for drying wet material to be ground, suck hot flue gases through a suction duct from the firing chamber of the boiler. Hence the rotor is subjected to a high temperature load during the grinding-drying process and during startup and rundown.

It is known how to cool the mill shaft over an inside bore-hole. Also, the mill shaft in the area of the entry cross-section of the mill can be enclosed with a shaft protection tube, with cooling air being conducted through the space between shaft protection tube and mill shaft.

With a known blower beater mill whose mill shaft is not equipped with an inside borehole for water cooling, the cooling air passing between shaft protection tube and mill shaft is passed through cooling channels located between the hub of the rotor and the shaft. In order to achieve adequate cooling of the mill shaft in this blower beater mill, large cooling air quantities must be passed through these cooling channels. Nevertheless, the mill shaft gets relatively hot so that the mill shaft cooled in this manner is inferior to a mill shaft cooled with water through an inside borehole.

It is, therefore, an object of the present invention to protect the mill shaft of a blower beater mill of the above type, in such a way, that high temperatures on the shaft crest and the temperature differential across the shaft cross-section are reduced.

Another object of the present invention is to provide an arrangement of the foregoing character which may be economically fabricated and readily maintained in service.

A further object of the present invention is to provide an arrangement, as described, which has a substantially long operating life.

SUMMARY OF THE INVENTION

The objects of the present invention are achieved by providing that the shaft crests of the hub rings are enclosed at a distance by an outside jacket which has cutouts for passage of the beater arms. The air in the space between the outer jacket and the shaft crests of the hub rings causes thermal insulation. In addition, the space may be filled with a suitable, heat-resistant material, e.g. asbestos. Also, a gaseous cooling medium may be passed through the space. In this manner, the mill shaft is protected in conjunction with the effective inside cooling against excessive temperature load. The cooling water in the inside borehole carries away the heat which penetrates the insulating layer inside the space and the shaft body so that the insulating effect and the inside cooling is effected.

The outer jacket can be continuous. The width of cutouts is greater than the width of the beater arm by the amount of maximum axial expansion of the outer jacket over the mill shaft.

Also, the outer jacket may be restricted to that part of the beater arm located underneath the mill entrance and reaches to the first row of the beater arms, viewed in the flow direction. Here the cooling effect is smaller than the previously described arrangement, but the beater arms can be dismantled easier. The space between two side rings can then be protected completely against the hot flue gases if the beater arm bases fill the space between two side rings, where the space between two beater arm bases in one beater arm row in the peripheral direction is at most 0.3 times the distance between two hub rings. With this arrangement, the shaft hubs are only barely exposed to hot flue gas in the region of the beater arms. Also, the possibility of dust depositing between the beater arm bases is reduced.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
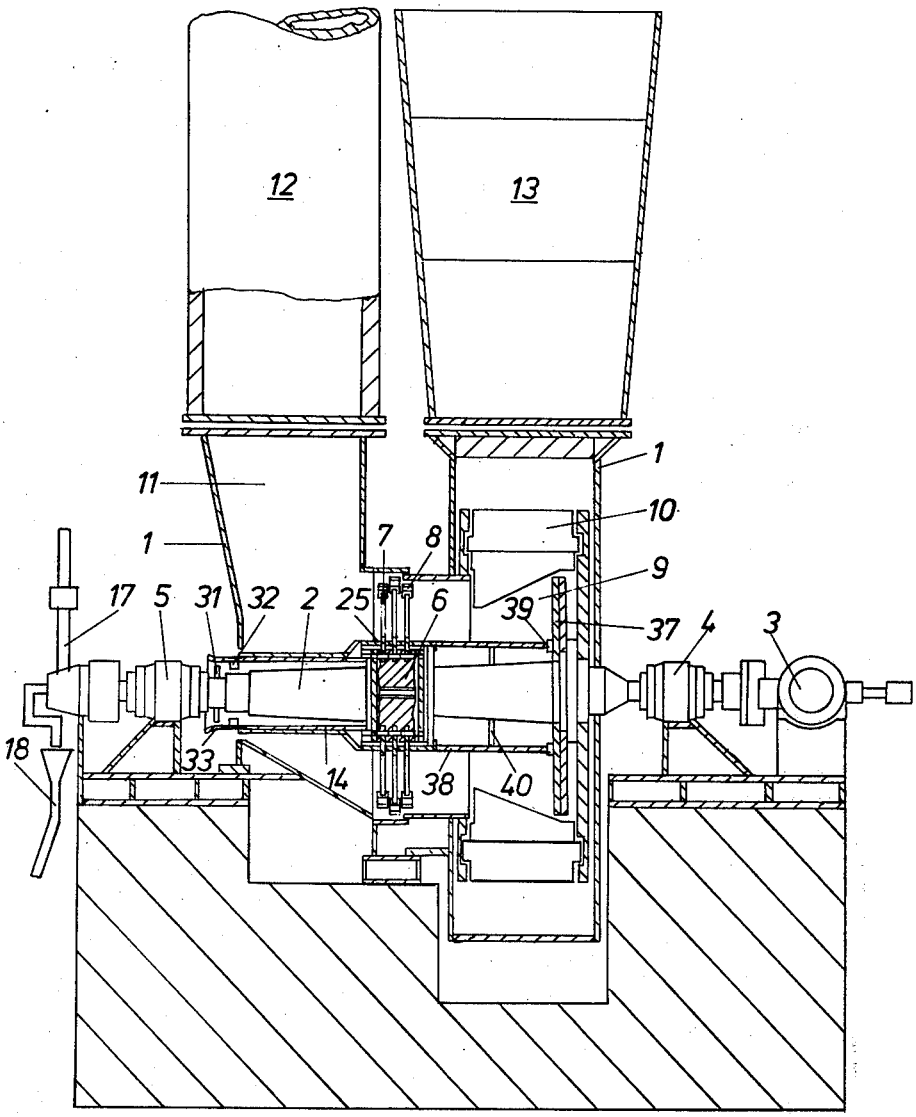
FIG. 1 shows a lengthwise section through a blower mill.

The blowerbeater mill contains a rotor located in a mill housing 1. The rotor comprises the mill shaft 2 which is driven by a motor 3 via a transmission and is held in two bearings 4 and 5 located outside the mill housing. The mill shaft 2 mounts a beater part 6 with several beater arms 7 and the attached beater heads 8 and fan impeller 9 with radial blades 10.

The fan impeller 9 acting as blower, through a suction duct 12 sucks in hot flue gas from the combustion chamber of a boiler (not shown). The material to be ground, in this case brown coal, is placed in the suction duct 12 and together with the hot flue gases reaches the mill through the mill chute 11. The crushed material is delivered to the burners of the combustion chamber (not shown) through a transition piece 13 and the dust line.

If, as shown in FIG. 1, the beater part 6 is not drawn into the zone of the mill chute 11, then the mill shaft 2 is surrounded in this zone by a fixed shaft protection tube 14. The mill shaft 2 is water-cooled on the inside and has a central borehole 15, for this purpose, through which a small diameter pipe 16 is passed. Pipe 16 is connected to the cooling water intake 17 outside the mill housing; the ring channel between the pipe 16 and the wall of the borehole 15 is connected to the cooling water return 18.

Grooves 19 are turned into the shaft body so that hub rings 20 are formed. The beater arms 7 are inserted in the grooves 19 between the hub rings. They are held by hub bolts 21 which pass through boreholes in the hub rings 20 and the beater arm bases 22. The hub bolts 21 are held fixed by lock disks 23 attached to the first and last hub ring 20.

The shaft crests 24 of hub rings 20 are enclosed at a distance by an outer jacket 25. The distance is maintained by spacers 26 which are welded to the inside of the outer jacket 25 and are held by the shaft crests (cams) 24 of the hub rings. The outer jacket 25 rotates with the rotor.

The outer jacket 25 has cutouts 27 through which the beater arms 7 pass. The width of cutouts 27 is greater than the width of the beater arms 7 by the amount of maximally occurring temperature-related axial expansion of the outer jacket 25 over the mill shaft. The outer jacket 25 is a cylindrical piece of sheet metal which is welded at the joining edges. The outer jacket 25 may also be formed from two half shells which are connected at the joints by an overlapping butt strap.

Figure 2:
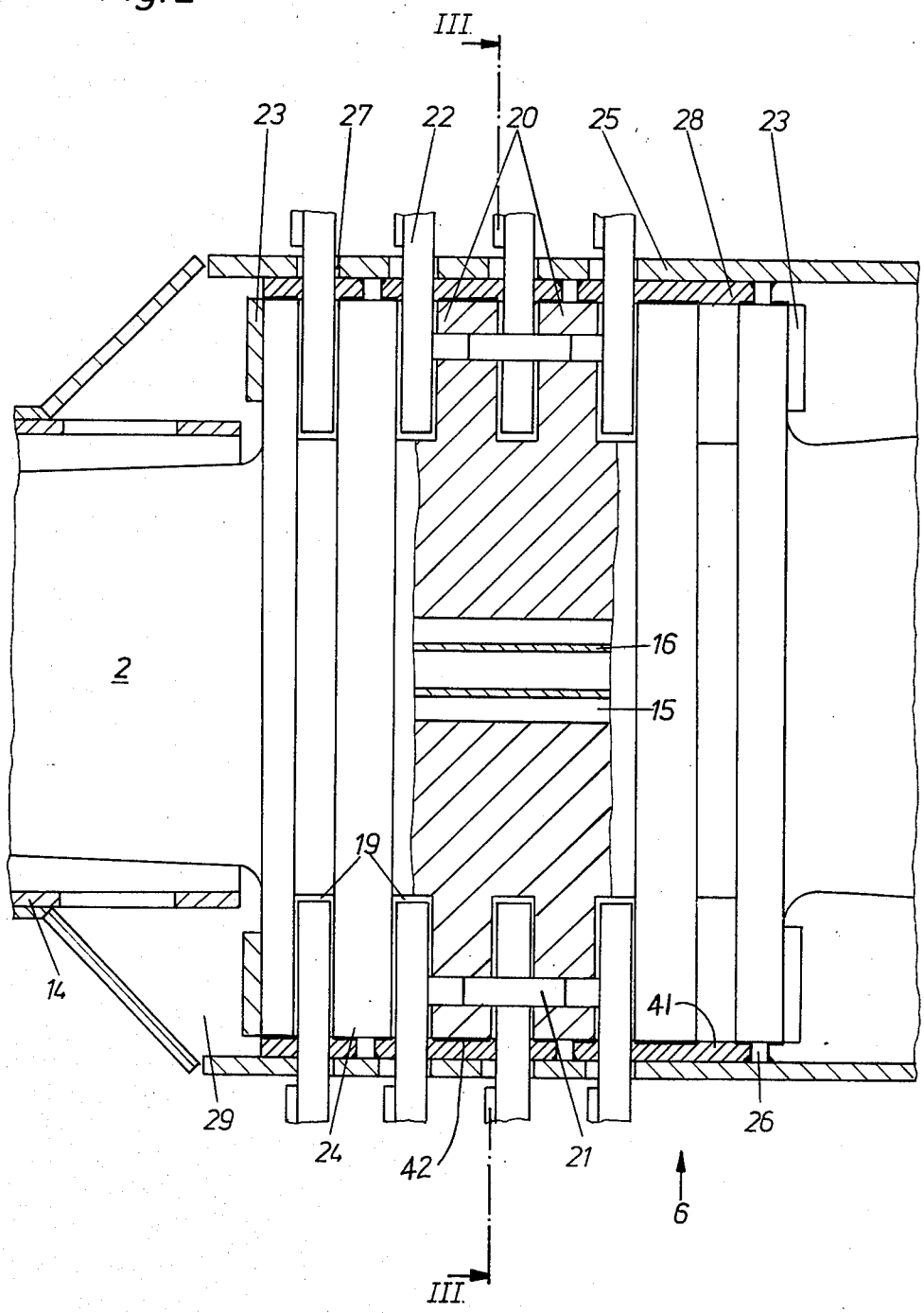
FIG. 2 shows the beater section of the blower mill in a lengthwise section.

In the case of FIG. 2, the outer jacket 25 covers the entire beater part. It is also possible that the outer jacket is restricted to the forward part of the beater part 6 which is exposed to the high temperatures, and reaches only to the first beater arm row or to the first beater arms rows.

In the space 28 between the shaft crests (cams) 24 of the hub rings 20 and the outer jacket 25, is air at rest which protects the shaft crests 24 against the high temperature of the flue gases. To increase the insulating effect, the space 28 can also be filled with an insulating material 41 like asbestos. Also, the shaft crests 24 may have a heat-reflecting layer 42, e.g. from sheet aluminum.

A gaseous coolant may be passed through the space 28 between the outer jacket 25 and the hub rings 20. This coolant may be cool air which is supplied from outside the blower beater mill through the free space between the mill shaft 2 and the shaft protection tube 14, enters an annular chamber 29, and flows from there through the space 28.

The space 28 may also be supplied with cooling air by providing an axial blower outside the mill housing 1 on the stub shaft present between the mill intake 12 and the bearing 5 which is a floating or loose bearing. This axial blower comprises a rotor 31 rotating with the mill shaft 2 which might be followed by a guide wheel 32 that is stationary relative to mill shaft 2. Rotor 31 rotates in a blower housing 33, which is provided with an intake portion and is connected to the mill housing 1. The discharge cross-section of the axial blower discharges into the free space between mill shaft 2 and shaft protection tube 14.

Figure 3:
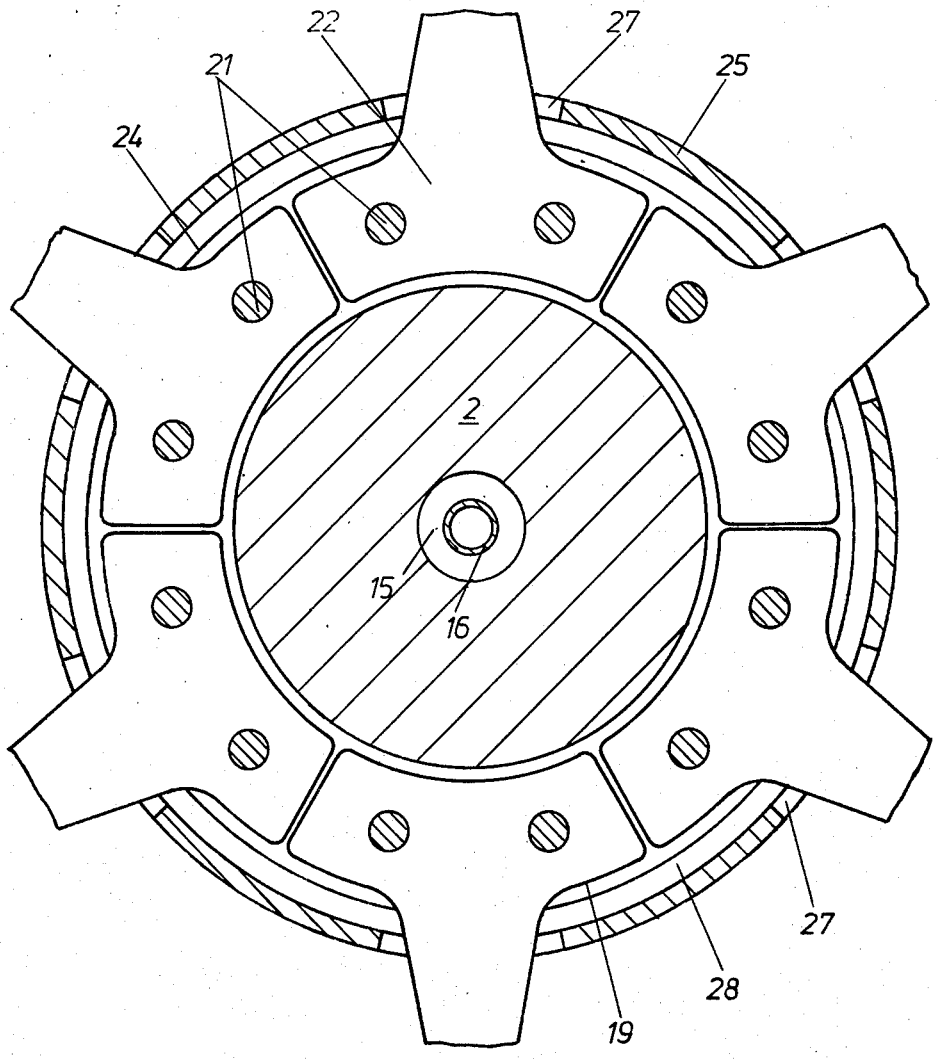
FIG. 3 shows a section taken along line III—III in FIG. 2.

Since the outer jacket 25 must have cutouts 27 for the beater arms, there is the danger that, in spite of the screening of the beater portion 6 by the outer jacket, hot flue gas may get into the grooves 19 between the hub rings 20 and may lead there to heating up or to dust deposits. To eliminate this, the beater arm bases 22 are enlarged so that they completely fill the groove 19 between two hub rings 20. In the embodiment shown in FIG. 3, the space between two adjacent beater arm bases 22 of one beater arm row in the peripheral direction is smaller than the 0.3 of the magnitude of the space between two hub rings 20, or the width of a groove 19.

Even though the temperature of the flue gases decreases continually during passage through the blower beater mill, it may still be recommendable to protect the mill shaft 2 also in the rear portion of the blower beater mill. For this reason, the mill shaft 2 is enclosed by a cylindrical jacket 38 between the beater portion 6 and the baffle plate 37 of the fan impeller 9. This jacket 38 represents the continuation of the outer jacket 25 and rests against the rear part of the beater portion 6 and square sections 39 mounted laterally on the baffle plate 37 of the fan impeller. Reinforcing members 40, which are welded into the jacket 38 and contact the mill shaft, maintain a distance of jacket 38 from the mill shaft 2.

The cooling gas passing through space 28 can be conducted to the space between jacket 38 and mill shaft 2. As discussed in connection with the outer jacket 25 enclosing the beater portion, an insulating effect can be provided by air at rest between the mill shaft 2 and the jacket 38, or by insulating material or by a combination of both.

Without further analysis, the foregoing will so fully reveal this gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

We claim:

1. A blower beater mill for grinding and drying, comprising: a mill shaft with hub rings; a rotor having a beater portion located on said mill shaft and having a fan impeller, said beater portion having beater arms; said beater arms of said beater portion being fastened in spaces between said hub rings of said mill shaft; said mill shaft being water-cooled along its longitudinal axis; said hub rings having shaft cams; and an outside jacket enclosing said shaft cams at a spaced distance therefrom; said outside jacket having cutouts for passage of said beater arms.

2. A blower beater mill as defined in claim 1, including insulating material filling the space between said outer jacket and said shaft cams.

3. A blower beater mill as defined in claim 1, including a heat-reflecting coating on said shaft cams of said hub rings.

4. A blower beater mill as defined in claim 1, wherein the width of said cutouts is greater than the width of said beater arms by an amount corresponding to the maximum axial expansion of the outer outside jacket relative to said mill shaft.

5. A blower beater mill as defined in claim 1, wherein said beater arms have bases filling space between two hub rings, the distance between two adjacent beater arm bases of a beater arm row in the peripheral direction being at maximum 0.3 times the distance between two hub rings.

6. A blower beater mill as defined in claim 1, including an auxiliary jacket enclosing a portion of said mill shaft located between said beater portion and said fan impeller, said auxiliary jacket resting against said beater portion and said fan impeller.

7. A blower beater mill as defined in claim 1, including insulating material filling space between said outside jacket and said shaft cams of said hub rings; a heat-reflecting coating on said shaft cams of said hub rings; the width of said cutouts being greater than the width of said beater arms by an amount corresponding to the maximum axial expansion of the outside jacket relative to said mill shaft; said beater arms having bases filling space between two hub rings, the distance between two adjacent beater arms bases of a beater arm row in the peripheral direction being at maximum 0.3 times the distance between two hub rings; and an auxiliary jacket enclosing a portion of said mill shaft located between said beater portion and said fan impeller, said auxiliary jacket resting against said beater portion and said fan impeller.

* * * * *